United States Patent [19]

Rydell

[11] 3,962,895

[45] June 15, 1976

[54] FLUID FORMING APPARATUS HAVING CONTROLLABLY VARIABLE FORMING PRESSURE

[75] Inventor: Nils Folke Rydell, Molndal, Sweden

[73] Assignee: Saab-Scania Aktiebolag, Linkoping, Sweden

[22] Filed: Dec. 4, 1974

[21] Appl. No.: 529,502

[30] Foreign Application Priority Data

Dec. 5, 1973 Sweden ..... 7316381

[52] U.S. Cl. ..... 72/63; 267/119

[51] Int. Cl.[2] ..... B21D 22/12

[58] Field of Search ..... 72/60, 63, 21, 22, 312, 72/407, 417, 453, DIG. 4, DIG. 5, DIG. 6; 267/119; 92/152

[56] References Cited

UNITED STATES PATENTS

| | | | |
|---|---|---|---|
| 3,290,919 | 12/1966 | Malinak et al. | 72/453 |
| 3,357,218 | 12/1967 | Mitchell | 72/63 X |
| 3,635,061 | 1/1972 | Rydell | 72/63 |
| 3,635,074 | 1/1972 | Moos et al. | 72/453 |

*Primary Examiner*—Lowell A. Larson

[57] ABSTRACT

Fluid forming apparatus having a constant-volume pressure cavity has oppositely movable rigid forming tool parts, each connected with a piston comprising a double acting cylinder mechanism. Forming pressure is developed by hydraulically forcing one tool part in the direction that tends to reduce cavity volume, thus, by reaction, forcing the other tool part in the opposite direction against restraint. A cam mechanism moving with said one tool part defines a pressure program. Sensor means, cooperating with the cam and with pressure regulating valve mechanism, controls pressure of the fluid driving said one tool part in accordance with the program and the position of that tool part.

8 Claims, 3 Drawing Figures

FLUID FORMING APPARATUS HAVING CONTROLLABLY VARIABLE FORMING PRESSURE

This invention relates to apparatus for the forming of sheet metal blanks, of the type wherein fluid pressure is applied to one face of a blank to force the blank to assume a shape that is determined by a rigid forming tool at its other face; and the invention is more particularly concerned with fluid forming apparatus wherein forming pressure is applied to the blank by means of fluid confined in a constant-volume pressure cavity.

Forming apparatus of the general type to which the present invention relates is disclosed in U.S. Pat. No. 3,635,061. Such apparatus comprises means defining a constant-volume pressure cavity, cooperating with a rigid forming tool. The forming tool comprises a pair of tool parts that are movable relative to one another in directions toward and from the cavity. One of the rigid tool parts can be a more or less annular blank holder or draw ring unit that provides a blank-engaging surface which faces towards the pressure cavity. The other rigid tool part, which is more or less surrounded by the blank holder, may be either a punch or a die.

The pressure cavity is defined by a cylinder member in which a quantity of fluid is contained, a plunger received in one end portion of the cylinder member with a slideable sealing fit, and a resilient diaphragm that closes the other end of the cylinder member and cooperates with the plunger to confine the fluid in the cylinder member. The exterior surface of the diaphragm opposes the blank engaging surface on the annular rigid tool part and cooperates with it to flatwise clampingly confine edge portions of a blank being formed.

During a forming operation, relative movement between the forming tool and the cavity means carries one of the tool parts in the direction inwardly of the pressure cavity. That tool part tends to reduce the volume of the cavity, but since the quantity of fluid confined in the cavity remains constant, the fluid is merely displaced. If, for example, that tool part is an upwardly moving punch, it deflects the central portion of the diaphragm upwardly into the pressure cavity, and as a result the cylinder member of the cavity means is displaced downwardly relative to its plunger. The cylinder member forces the draw ring unit to move downwardly with it, but such downward movement of the draw ring unit is yieldingly resisted. The fluid in the cavity is thus subjected to a pressure which depends upon the resistance to downward movement of the draw ring unit, and such pressure, imposed through the diaphragm upon the entire upper surface of a blank to be formed, forces the blank into a shape determined by the rigid forming tool.

In the press attachment of U.S. Pat. No. 3,635,061, the plunger of the constant volume pressure cavity was secured to the movable upper jaw of a press, and each of the rigid tool parts comprised a piston that was movable up and down in a cylinder which rested on the press table. Each of the cylinders thus defined a pressure chamber beneath its piston, and these pressure chambers were interconnected. Hence as one of the pistons was forced down into its cylinder by downward motion of the movable press jaw, the fluid displaced from its pressure chamber was transferred into the lower chamber for the other piston, causing the latter to move upwardly in its cylinder. Such upward motion was yieldingly opposed by a body of fluid in the upper portion of the cylinder of the upwardly moving piston, which fluid was controlledly bled out of that cylinder. Forming pressure in the constant-volume pressure cavity thus depended upon the rate of downward motion of the movable press jaw as well as upon the restriction to flow of fluid out of the pressure chamber above the upwardly moving rigid tool part.

In any hydraulic forming apparatus wherein fluid in a pressure cavity exerts the forming force upon the blank, it is necessary to control the pressure of that fluid during the forming operation. In the forming of a deeply drawn part, such control of forming pressure is especially important, inasmuch as the forming pressure should usually be increased at a more or less steady rate as forming progresses. In the forming apparatus of U.S. Pat. No. 3,635,061, there were sensing and control devices for automatically regulating fluid outflow from the pressure chamber beneath the downwardly moving rigid tool part, such regulation being effected partially in response to the pressure prevailing in that chamber and partially in response to the rate of motion of the upwardly moving rigid tool part.

U.S. Pat. No. 2,783,727 discloses forming apparatus in the nature of a press attachment wherein the rigid tool parts are movable in opposite directions, without any substantial restraint being imposed upon the movements of either of them, and wherein forming pressure is controlled during the forming operation by varying the volume of fluid in the pressure cavity. That expedient for control of forming pressure is undesirable for several reasons. For one, it is difficult to effect accurate throttling of flowing fluid that is subjected to the extremely high pressures that obtain in the pressure cavity during a forming operation, which pressures can attain values as high as 2,000 Kg./cm$^2$. It is also difficult to meter just the right amount of fluid back into or back out of the pressure cavity at the completion of a forming operation, to establish the diaphragm in the right condition for initiation of the next succeeding forming operation.

With these considerations in mind, it is an object of the present invention to provide fluid forming apparatus having a pressure cavity of constant volume and wherein the forming pressure in the pressure cavity is exerted solely by the forming tool, so that control of such pressure can be effected in a relatively simple manner, even when the forming pressure must vary during the course of a forming operation.

Another object of this invention is to provide, in a hydraulic forming press having a constant volume pressure cavity, simple and effective control means whereby the forming pressure can be closely and continuously regulated all during the forming operation, in accordance with a predetermined program, so that the pressure can be increased at a suitable rate as the forming progresses. Still another object of this invention is to provide a press wherein the means for generating forming pressure in the cavity and the means for regulating such pressure both operate at fluid pressures that are relatively low and hence easily controlled and contained.

A further object of this invention is related to the fact that the apparatus in which the invention is embodied can comprise a self-contained press, rather than merely a press attachment. In fluid forming apparatus of the type here under consideration, wherein the rigid tool parts move in opposite directions during actual forming, the punch should be at the same level as the blank-holding unit — or slightly below that level — at the point in the stroke at which the blank begins to be subjected to clamping force.

At the conclusion of the forming operation, and after the formed blank is disengaged from the pressure cavity diaphragm, the rigid tool parts should be brought back to that same starting relationship to one another, to disengage the punch from the formed workpiece. When the press is open, the space between the forming tool and the pressure cavity should be about equal to the depth of a workpiece to be formed, to leave room for withdrawal of formed workpieces from the apparatus; and therefore the tool parts should also be in the starting relationship to one another at that time, to afford maximum spacing with a minimum press stroke. The two tool parts should of course move in unison from their press-open positions to their positions at which clamping force begins to be imposed upon the blank.

In the press attachment of U.S. Pat. No. 3,635,061, coordinating the sequence of movements of the forming tool parts was a relatively simple matter, inasmuch as the press-opening and press-closing motion was effected by movement of the movable press jaw, by which the pressure cavity means was carried, and consequently the rigid tool parts were only required to move in opposite directions relative to one another. The press table could therefore serve as a reference level so that they could be readily brought to their starting relationship to one another.

But where fluid forming apparatus of the general type disclosed in that patent is to be embodied in a self-contained press, the apparatus must accommodate not only relative motion between the rigid tool parts during the forming portion of the press stroke but also relative press-opening and press-closing motions as between the pressure cavity means and the forming tool as a whole. Control of forming pressure by control of the forming tool implies that it is to the rigid tool parts, rather than the pressure cavity means, which should make the press-opening and press-closing movements. This is to say that the pressure cavity means should remain stationary and that the movements of the tool parts, both with one another and relative to one another, must be properly coordinated so that they will have the proper positions, in relation to one another and in relation to the cavity means, in every part of the cycle.

With the foregoing in mind, it is another object of this invention to provide simple means in fluid forming apparatus of the character described for achieving the above described sequence of movements of the rigid tool parts, while also maintaining such control over the tool parts as will assure desired forming pressures during every part of the forming operation.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate two complete examples of embodiments of the invention constructed according to the best modes so far devised for the practical application of the principles thereof, and in which.

Figure 1:
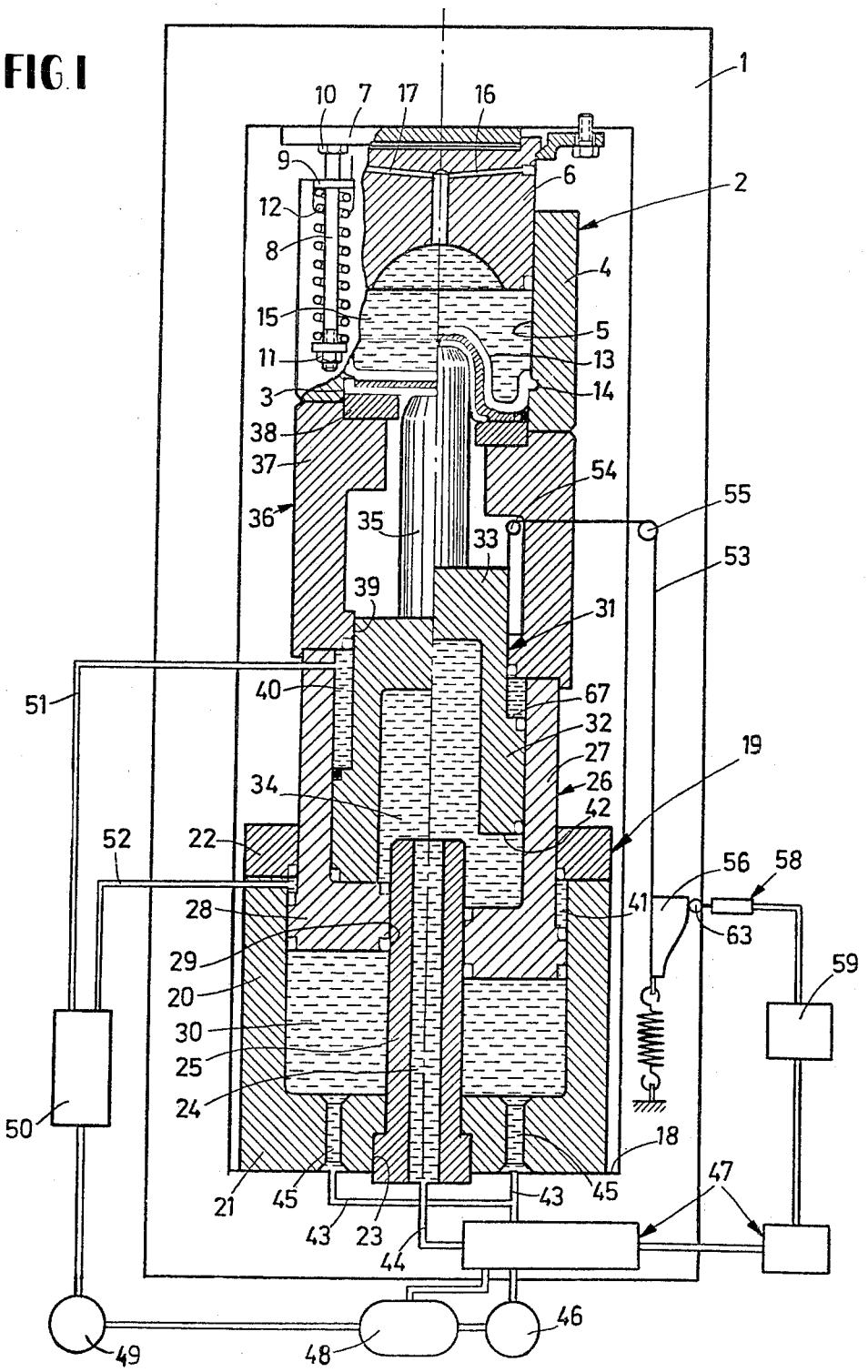
FIG. 1 is a longitudinal sectional view of a forming press embodying the principles of this invention, shown in the left hand half of the drawing in its condition just before a forming operation begins and in the right hand half of the figure in its condition at the completion of a forming stroke.

Referring now to the accompanying drawings, the numeral 1 designates an upright, rigid frame having vertically spaced top and bottom portions to which are secured the cooperating force applying members which comprise the forming press of this invention. To the upper portion of the frame there is secured means defining a constant volume pressure cavity, designated generally by 2. To the lower portion 18 of the frame there is secured a hydraulic unit 19 that provides for actuation of a rigid forming tool comprising a pair of tool parts 35 and 38 which are movable relative to one another and to the pressure cavity means 2. As shown, the rigid tool part 38 comprises an annular draw ring unit or blank holding unit, and the tool part 35 comprises a punch that is surrounded by the draw ring unit.

The hydraulic unit 19 comprises a stationary cylinder 20, an outer piston element 26 that is movable up and down in the stationary cylinder and comprises a movable cylinder 27, and an inner piston element 31 that is movable up and down in the movable cylinder.

The outer piston element 26 carries at its upper end the blank holding unit or draw ring unit 38, while the other rigid tool part 35 is fixed to the top of the inner piston element 31.

During a forming operation, a sheet metal blank 3 is compelled to take a shape determined by the rigid tool, under the influence of force exerted over its entire upper surface by the constant volume cavity means 2. The cavity means comprises a plunger 6 that is fixed to the upper portion of the frame 1, a cylinder member 4 that has the plunger received in its upper end portion with a slideable sealing fit, and a more or less cup-shaped resilient diaphragm 13 that extends across the bottom of the cylinder member 4 to close the same and cooperate with it and the plunger 6 in confining a quantity of fluid 15. It will be understood that the bore 5 in the cylinder member is machined to have an accurate fit on the plunger 6, and that the plunger is encircled by at least one sealing ring.

The plunger 6 is secured to the underside of a mounting plate 7 that is fixed on the top portion of the frame. Also extending down from that mounting plate, at spaced locations around the cylinder member 4, are a number of rigid vertical struts 8 which can be threaded into the mounting plate and secured with locking nuts 10. Brackets 9 that project radially from the cylinder member 4 near the top thereof are slideably guided on these struts, and each strut is surrounded by a coiled expansion spring 12 that reacts between the bracket 9 and a nut 11 that is threaded onto the bottom of the strut. The springs thus bias the cylinder member upwardly, to maintain some pressure upon the fluid 15 in the cavity and, of course, to bias the cylinder member 4 towards a neutral position in which it is illustrated in the left-hand half of FIG. 1 and to which it returns after each forming operation. To enable the cavity to contain an ample quantity of fluid, the underside of the plunger is preferably concavely dished, as shown. The pressure cavity can be charged with fluid through a sealable filling passage 16 that leads down through the plunger from its upper portion, and air displaced during filling can pass out of the cavity by way of a sealable vent passage 17 through the plunger. It will be understood that no fluid enters or leaves the pressure cavity during a forming operation.

The diaphragm 13 has a cylindrical side wall, around the exterior of which there is a circumferential bead 14 that is received in a closely-fitting groove in the bore surface of the cylinder member 4. As is conventional, a clamping ring (not shown), encircling the inner surface of the diaphragm side wall, confines the bead 14 In its groove to secure the diaphragm in place. The bottom wall of the diaphragm has a substantially flat underside, and the diaphragm thus provides a downwardly facing blank engaging surface which opposes the upwardly facing surface of the blank holding unit 38 and which cooperates with the latter to flatwise clampingly confine the edge portion of a sheet metal blank being formed. The diaphragm also serves as a medium whereby reaction forces produced in the body of fluid 15 within the cavity are imposed upon and distributed over the top surface of the blank, to compel the blank to assume the shape determined for it by the rigid tool.

The hydraulic unit 19 that comprises the actuating means for the rigid tool parts is, in general, a telescoping arrangement of coaxial cylinder means and pistons. Its largest diameter component is the stationary cylinder 20, which is fixed to the bottom portion 18 of the rigid frame and which is generally cup-shaped and opens upwardly. The stationary cylinder has a uniform inside diameter through most of its height, but a ring 22 that is coaxially affixed to its rim defines a reduced diameter bore at its upper end portion.

The outer piston element 26 has a uniform outside diameter along most of its length, such as to have a slideable sealing fit inside the ring 22, but at its bottom it has a coaxial larger diameter portion 28 which has a slideable sealing fit in the larger-diameter bore portion of the stationary cylinder. Beneath this larger diameter portion of the outer piston element, and in part defined by it, the stationary cylinder has a lower pressure chamber 30. The larger diameter portion 28 of the outer piston element also cooperates with the fixed ring 22 to define, in the interior of the stationary cylinder, an annular pressure chamber 41, so that the piston element 26 and the stationary cylinder 20 comprise a double-acting cylinder mechanism.

Affixed to the top of the outer piston element 26 is a rigid carrier 36 that has an axially elongated annular body 37. Attached to that carrier, or made integral therewith, is the draw ring unit or blank holding unit 38, said unit being here illustrated as a separate ring that is removably received in a closely fitting well in the top of the carrier.

The smaller diameter upper portion of the outer piston element 26 is hollow and defines the coaxial movable cylinder 27 in which the inner piston element 31 is sealingly slideable up and down. The movable cylinder is thus generally cupshaped, and its interior opens upwardly. The carrier 36 has a lower annular portion 39 that projects radially inwardly from the rim of the outer piston element to define a coaxial reduced diameter upper bore portion for the movable cylinder.

The lower portion 32 of the inner piston element 31 has an outside diameter such as to have a slideable sealing fit in the larger inside diameter portion of the movable cylinder, and it has a smaller diameter upper portion that is received with a similar fit in the smaller bore portion of the movable cylinder that is defined by the carrier 36. Note that the lower portion 39 of the carrier 36 cooperates with the enlarged outside diameter portion 32 of the inner piston element to define a second upper annular pressure chamber 40, in the movable cylinder. The inner piston element also cooperates with the movable cylinder to define a second lower pressure chamber 34, so that these cooperating parts constitute another double-acting mechanism.

The second lower pressure chamber 34 is of substantially large volume inasmuch as the inner piston element is of inverted cup shape, with an end wall 33 across its top. The radially inner one of the two rigid forming tools, here shown as the punch 35, is concentrically fixed to said end wall 33 and projects upwardly therefrom. The tool part 35 can of course be removable, so that it can be replaced with rigid tool parts of other shapes and sizes, including die or matrix parts as well as other punch parts.

Fluid can flow into and out of the first lower pressure chamber 30, in the stationary cylinder, by way of eccentric passages 45 through its bottom wall 21, which passages communicate with ducts 43. Fluid can flow into and out of the first upper pressure chamber 41, in that cylinder, by way of a duct 52 that connects with a passage through its side wall.

To conduct fluid to and from the second lower pressure chamber 34, in the movable cylinder 27, there is a tubular member 25 that is fixed in a closely fitting bore 23 in the bottom wall of the stationary cylinder and projects upwardly to about the level of the ring 22. That tube has a slideable sealing fit in a concentric bore 29 through the bottom wall of the cup-shaped outer piston element 26, through which bore the tube projects into the second lower pressure chamber 34. A duct 44 is connected with the tubular member at its bottom end, and it will be evident that fluid can flow between that duct and the second lower pressure chamber 34 by way of the bore 24 of the tubular member 25. The substantial axial depth of the interior of the inverted cup-shaped inner piston element provides for clearance between the top of the tubular member and the upper end wall 33 of that piston element, even when the two piston elements are bottomed in their respective cylinders.

Fluid can flow into and out of the second upper pressure chamber 40, in the movable cylinder, by way of a passage in its side wall that is connected with a flexible duct 51.

It will be understood that the several slideable seals mentioned above comprise suitable sealing rings.

In the illustrated arrangement, wherein the inner rigid tool part 35 is shown as a punch that moves upwardly relative to the other tool part 38 during the forming portion of the stroke, the two rigid tool parts are so arranged that when the inner piston element 31 is bottomed in the movable cylinder 27, the top of the punch 35 is at or slightly below the level of the blank holder 38. It will be apparent that if the two rigid tool parts are brought into this relationship to one another when they are in their press-open positions, then they can be readily moved upward in unison to their positions illustrated at the left-hand side of FIG. 1, in which the blank 3 just begins to be subjected to clamping force. Such unison upward movement of the tool parts is of course effected by filling fluid into the first lower pressure chamber 30 and allowing the inner piston element to be carried upwardly by the outer one. The bottom of the inner piston element and the bottom of the movable cylinder thus serve as cooperating abutments that define the starting positions of the tool parts relative to one another.

During the portion of the stroke in which forming is effected, as will be apparent from the right-hand side of FIG. 1, fluid is forced into the second lower pressure chamber 34 to effect upward motion of the inner piston element and the punch 35 that is carried by it. Such upward motion of the punch of course effects an upward and inward resilient deformation of the central portion of the diaphragm, displacing fluid to cause a corresponding downward displacement of the circumferential portion of the diaphragm along with the cylinder member 4 that carries it. As the punch is being forced upwardly, fluid is restrainedly permitted to bleed out of the first lower pressure chamber 30, and consequently the draw ring unit 38 can descend against yielding resistance and in response to the downward reaction force imposed upon it by fluid in the pressure cavity. With pressure thus imposed upon it, the fluid in the cavity, acting through the diaphragm, applies force over the entire top surface of the blank whereby the blank is compelled to assume a form determined by the rigid tool parts.

At the conclusion of the forming operation, cooperating abutments on the two tool parts can engage to define their forming relationship to one another, towards which relationship they are shown moving in the right-hand side of FIG. 1. As shown, these abutments comprise the circumferential upwardly facing shoulder 67 on top of the larger diameter portion 32 of the inner cylinder element 31 and the bottom of the bore-defining portion 39 of the carrier 36. The tool parts can therefore be moved downwardly in unison by allowing fluid to flow into the first annular upper pressure chamber 41 and simultaneously permitting fluid to flow out of the first and second lower pressure chambers 30 and 34. Keeping the two tool parts in their forming relationship to one another until the newly formed workpiece is clear of the diaphragm enables the forming tool to support the workpiece against deformation by fluid pressure acting through the diaphragm.

Once the unison descent of the rigid tool parts has carried the workpiece clear of the diaphragm, fluid can be pumped into both of the upper pressure chambers 40 and 41 and exhausted from the two lower pressure chambers 34 and 30 to bring the rigid tool parts to their press-open positions, in which both piston elements are bottomed in their respective cylinders and the punch is freed from the workpiece.

It will be obvious that a mere reversal of the illustrated relationships of the abutments that define the relative positions of the tool parts would allow the male punch member 35 to be replaced by a female die or matrix that was intended to move downwardly relative to the draw ring unit 38 during the forming operation. Specifically, the circumferential shoulder 67 on the inner piston element would engage the underside of the carrier 36 to establish the rigid tool parts in their starting relationship, and the inner piston element would bottom in the movable cylinder to establish the forming relationship.

It will be apparent that the abutments which define the respective starting and forming relationships could be on the tool parts themselves instead of on the components of the hydraulic unit 19, so that a variety of interchangeable forming tools could be accommodated.

The ducts 43 that communicate, through the passages 45, with the first lower pressure chamber 30 are connected with valve means 47. Also connected with the valve means 47 are a source of pressure fluid, here shown as a pump 46, a tank or fluid reservoir 48, and the duct 44 that communicates with the second lower pressure chamber 34 by way of the bore 24 in the tubular member 25. The valve means 47, as explained below, serves to direct pressure fluid into one of the lower pressure chambers 30 or 34 during a forming operation and to control the pressure of fluid issuing out of the other of those pressure chambers. The connection between the valve means 47 and the reservoir 48 permits a portion of such outflowing fluid to be exhausted to the reservoir. There is also a connection between the reservoir and the pump 46 through which the latter can draw fluid from the reservoir.

The ducts 51 and 52, which communicate with the annular upper pressure chambers 40 and 41, respectively, are communicable with a low pressure auxiliary pump 49 through another valve 50. The auxiliary pump also has an inlet connection with the reservoir 48. Although not shown, it will be understood that there is a return fluid connection between the valve 50 and the reservoir. The hydraulic system that comprises the auxiliary pump 49 and the valve 50 functions during movement of the rigid tool parts in their return strokes, when the tool parts are brought back to their press-open positions from the positions they occupy at the conclusion of a forming stroke. During that time, of course, the valve 50 directs the output of the pump 49 into the first upper pressure chamber 41 until the outer piston element 26 has bottomed therein, and then directs the pump output into the second upper pressure chamber 40.

The hydraulic system comprising the pump means 46 and the valve means 47, which is essentially independent of the system comprising the pump 49 and the valve means 50, produces and controls pressures applied during the forming operation to the piston elements that carry the rigid tool parts. In order to control the forming pressure in accordance with the relative position of the tool parts, there is associated with the valve means 47 a sensing and control system comprising a cam template 56 that is constrained to move with at least the inner piston element 31, and a sensor 58 that cooperates with the cam template and with a potentiometer 60 to produce signals for control of the valve means 47.

As shown, the cam template 56 is confined to up and down sliding movement, and it is constrained to move with at least the inner piston element 31 by means of a cord or cable 53 which is connected between it and that piston element and which is trained over guide pulleys 54 and 55. It will be understood that the cord 53 can pass through an opening in the carrier 36. It will also be appreciated that the template is interchangeable with others, to accommodate different forming tools, each template having its camming surface so profiled as to represent a desired program of forming pressure variation relative to position of the forming tool parts during a forming operation with the tool for which it is intended.

Figure 3:
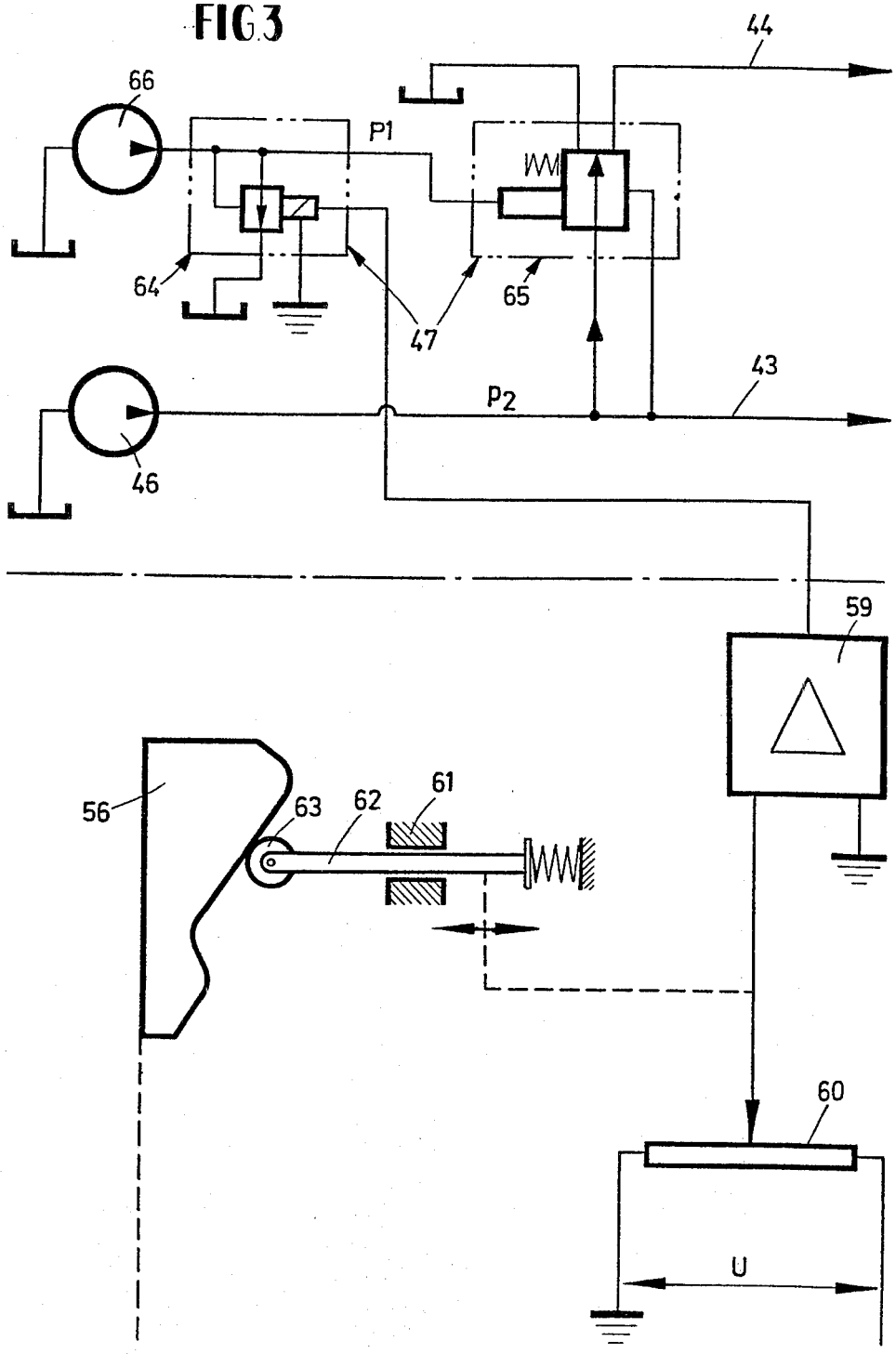
FIG. 3 is a diagram of the pressure regulating system of the presses shown in FIGS. 1 and 2.

FIG. 3 illustrates details of the pressure programming apparatus. The camming surface of the template cooperates with a cam follower 62 that adjusts the potentiometer 60. As illustrated, the cam follower comprises a plunger-like element that is lengthwise slideable in fixed guide means 61 in directions transverse to the directions in which the template moves. A roller 63 or the like on the cam follower, at its end adjacent to the template, tracks on the template camming surface, being maintained in engagement therewith by a lengthwise biasing force on the cam follower.

There is a constant potential difference, denoted by U, between the two ends of the potentiometer 60, and there is a mechanical connection between its slideable element and the cam follower plunger, so that the potential at the potentiometer slider corresponds to the forming pressure desired when the forming tool is in the position that it momentarily occupies. The potential at the slider thus constitutes a pressure demand value signal, and the slider has an input connection to an amplifier 59 by which that signal is amplified.

The valve means 47 comprises an electrohydraulic pressure control valve 64 and a proportional pressure regulating valve 65 that has two throttling orifices. The pressure control apparatus also includes a pump 66 for producing a control output having a substantially lower pressure than the output of the pressure source pump 46.

The pressure control valve 64 is in effect a pilot valve which receives pressurized fluid from the lower pressure pump 66 and meters it to the actuator of the proportional pressure regulating valve 65. The amplified pressure demand value signal that constitutes the output of the amplifier 59 is fed to a solenoid control device of the pressure control valve 64, which device causes the pressure P1 of pilot fluid issuing from that valve to be proportional to the pressure demand value signal derived from the potentiometer 60.

The pressure regulating valve 65 comprises a hydraulic actuating cylinder to which the fluid at the P1 pressure is delivered, and that valve also has an inlet connected with the duct 43 that communicates the high pressure pump 46 with the first lower pressure chamber 30. The two outlets of the valve 65 are respectively connected to the reservoir 48, in return relation thereto, and to the duct 44 that communicates with the lower pressure chamber 34 in the movable cylinder.

The hydraulic actuator of the pressure regulating valve 65, acting in response to the P1 pressure fluid from the pressure control valve 64, so proportions the amounts of fluid from the duct 43 that are diverted to the duct 44 and returned to the reservoir as to maintain pressure in the duct 43 at a value P2 which is in direct proportion to the P1 pressure value and hence in conformity with the prevailing pressure demand value signal. In this way the pressure regulating valve so controls the pressure of the fluid in the first lower pressure chamber 30 that said pressure will correspond to the demand value signified by the position of the plunger 62 in its engagement with the template. The valve 65 functions to limit the pressure in the chamber 30 primarily by causing hydraulic pressure fluid to be discharged from it into the second lower pressure chamber 34. However, if pressure in the chamber 30 is required to be reduced more rapidly than can be accommodated by such transfer of fluid to the chamber 34, then the valve 65 vents fluid to the reservoir 48 as necessary to bring pressure in the chamber 30 to the desired value.

Although the apparatus is here illustrated with a punch as its forming tool part 35, the punch, as indicated above, could be replaced by a die or matrix for die forming. In that case the connections of the pressure regulating valve 65 to the ducts 43 and 44 would in effect be reversed, so that during the actual forming operation pressure fluid would be fed to the first lower pressure chamber 30, to force the outer piston element upwardly, and fluid would be controlledly vented from the second lower pressure chamber 34, to permit the matrix or die to descend against restraint.

Figure 2:
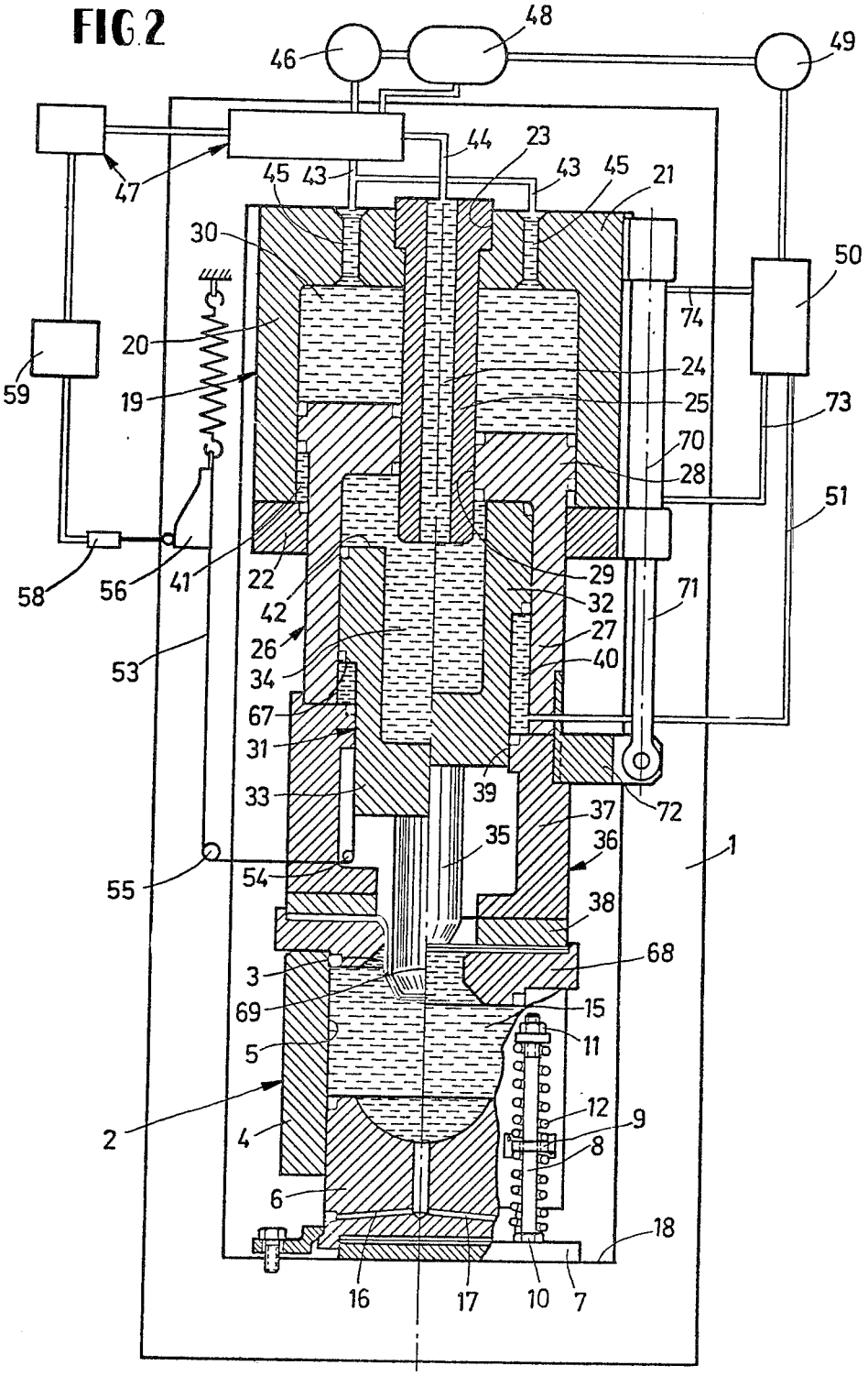
FIG. 2 is a view generally similar to FIG. 1 but illustrating a modified embodiment of the invention.

The modified embodiment of the invention that is illustrated in FIG. 2 is like that illustrated in FIG. 1, but inverted. Since its pressure cavity means 2 is at its bottom, there is no diaphragm, and instead the cylinder member 4 has a resilient and rather heavy sealing ring or annular wall element 68 around its upper edge, against which a blank 3 to be formed is sealingly flatwise engaged under the downward force exerted upon the blank by the forming tool. The blank thus cooperates with the ring 68 to seal the fluid 15 into the cavity, and the fluid is directly in contact with the under-face of the blank during the forming operation.

The press illustrated in FIG. 2 also differs from that illustrated in FIG. 1 in that the hydraulic unit 19 comprises, in addition to the telescoping cylinder-and-piston arrangement described above, a plurality of double-acting hydraulic jacks 70, each connected between a fixed upper portion of the frame and the outer piston element 26. The cylinder of each hydraulic jack is thus fastened to the upper frame member, and its downwardly extending piston rod 71 is connected to a radially outwardly projecting bracket 72 on the outer piston element and thus with the draw ring unit 36. Each of the hydraulic jacks has duct connections 73, 74 at the opposite ends of its cylinder that are communicated with the valve 50 connected with the auxiliary pump 49. The double acting jacks 70 thus effect press-opening and press-closing motion, and the several pressure chambers of the hydraulic unit 19 can function only during the actual forming operation.

It will be apparent that numerous modifications of the herein-illustrated structure are within the scope of the invention. For example, the stationary cylinder 20 and its cooperating outer piston element 26 could comprise a ring of individual cylinders, each having its own piston, and the several such pistons could be connected with one another through their common connection with a draw ring unit, all as illustrated in FIG. 4 of U.S. Pat. No. 3,635,061.

From the foregoing description taken with the accompanying drawings it will be apparent that this invention provides a fluid forming apparatus having a constant volume pressure chamber and having simple and effective means for controlledly varying forming pressure during the forming operation in accordance with the position of the forming tool.

Those skilled in the art will appreciate that the invention can be embodied in forms other than as herein disclosed for purposes of illustration.

The invention is defined by the following claims:

1. A fluid forming apparatus having a forming tool comprising a pair of rigid tool parts that are movable in opposite directions, a piston element for each tool part, a cylinder for each piston element, and means defining a constant-volume pressure cavity in which there is confined a quantity of fluid by which force can be exerted over one face of a sheet metal blank to shape the blank to a configuration determined by the forming tool, and wherein each of the tool parts is constrained to move with its piston element and each piston element cooperates with its cylinder to define a pressure chamber at the side of the piston remote from the pressure cavity means, said apparatus being characterized by:

A. pressure control valve means connected with a source of fluid under pressure and having a connection with the pressure chamber of each of said cylinders, said valve means being responsive to demand value signals
   1. to direct fluid from said source to one of said pressure chambers, and thus cause one of said tool parts to be moved in a direction inward of the pressure cavity means with resultant displacement of fluid therein, and
   2. to maintain pressure in the other pressure chamber at a value signified by a prevailing demand value signal applied to the valve means, while permitting outflow of fluid from said other pressure chamber, so that movement of the other tool part in the opposite direction, due to displacement of fluid in the pressure cavity means, is yieldingly restrained and fluid in the pressure cavity remains under a pressure determined by the demand value signal; and B. signal generating means for producing pressure demand value signals to which said valve means can respond and which correspond to the pressures desired in the pressure cavity means from instant to instant during a forming operation as related to the instantaneous relative positions of the forming tool parts and in accordance with a predetermined program of pressure variation, said signal generating means comprising
   1. cooperating camming elements, one of which is confined to motion in opposite directions and is connected with at least one of the rigid tool parts to move in correspondence with motions of that rigid tool part, and the other of which is movable transversely to said opposite directions,
      a. one of said camming elements comprising a cam having a profile denoting said program,
      b. the other of said camming elements comprising a cam follower engaged with said profile, and
   2. output means connected with said transversely movable camming element for producing an output having a magnitude which corresponds to the instantaneous position of said transversely movable camming element and which constitutes said demand value signal; and C. means connecting said output means in controlling relation to said valve means.

2. A press actuatable by fluid pressure medium and having a rigid forming tool by which sheet metal blanks can be formed, wherein the forming tool comprises a pair of tool parts which engage one face of a blank during forming and which are movable in a pair of opposite directions, one of said tool parts substantially surrounding the other and providing a first blank engaging surface that faces in one of said directions, said tool parts being cooperable with means defining a constant volume cavity filled with fluid, for maintaining a reaction force upon the opposite face of a blank during forming, said means defining said cavity comprising a cylinder member having a plunger relatively movable in one end portion thereof and having means at its other end defining a second blank engaging surface which is cooperable with the first blank engaging surface to flatwise clampingly confine edge portions of a blank, said press being characterized by:

A. A rigid frame having a pair of opposite portions that are spaced apart in said directions, said plunger being fixed to one of said portions, and said cylinder member being axially movable toward and from the other portion;

B. a stationary cylinder fixed to the other of said portions of the frame;

C. a first piston element movable in said directions and
   1. having one end portion received in said stationary cylinder and cooperating with the same to define a first pressure chamber at the side of the first piston element remote from said cavity means,
   2. said first piston element having said one rigid tool part at its other end, and
   3. said first piston element having a portion which is hollow and which comprises a movable cylinder;

D. a second piston element movable in said directions, both with the movable cylinder and relative to the same, said second piston element
   1. having one end portion received in the movable cylinder and cooperating therewith to define a second pressure chamber at the side of said second piston element that is remote from said cavity means, and
   2. having said other rigid tool part at its other end;

E. cooperating stop means constrained to move with said tool parts and engageable to define a limit of motion of one of said tool parts relative to the other at which said rigid tool parts are disposed substantially at a common level, said one tool part being movable relative to the other from said limit to a forming position in which the tool parts cooperate to define a shape to which a blank is to be formed;

F. means for introducing pressure fluid from a source thereof into the pressure chamber associated with the other tool part to move said rigid tool parts, with the stop means engaged, in unison from a press-open position in which both tool parts are spaced a substantial distance from said cavity and towards a press-closed position in which said blank engaging surfaces are juxtaposed; and G. means for forcing pressure fluid simultaneously into both of said pressure chambers and for venting fluid from said source as necessary to maintain a desired pressure in one of said pressure chambers, to effect forming of a blank confined between said surfaces.

3. A press for forming sheet metal blanks, comprising a cylinder member having a surface at one of its ends that is engageable with one face of a blank to be formed, a plunger movable in the other end portion of the cylinder member and cooperating with it to define a constant volume pressure cavity which is filled with fluid, and a hydraulically operated forming tool comprising a pair of tool parts for engaging the other face of a blank and each of which is movable in directions axially of the cylinder member, one of said forming tool parts substantially surrounding the other and being cooperable with said surface on the cylinder member, during forming of a blank, to flatwise clamp edge portions of the blank, said forming tool further comprising a pair of piston elements, one for each of said tool parts and each connected with its tool part, and means cooperating with each piston element to define a pressure chamber for it that is at its end remote from the pressure cavity means, said press being characterized by:

A. an upright rigid frame having a pair of vertically spaced portions that are fixed in relation to one another,
   1. one of said frame portions having the plunger fixed thereon, with the cylinder member axially movable on the plunger toward and from the other of said frame portions, and
   2. the forming tool being supported on the other of said frame portions with at least one of its pressure chamber means fixed thereto;

B. cooperating stop means connected with the respective rigid tool parts to move therewith and engageable to define a limit of motion of one of said tool parts relative to the other in which the blank engaging portions of said tool parts are at substantially a common level, said stops being so arranged that said one tool part is movable relative to the other from said limit to a forming position in which the tool parts cooperate to define a shape to which a blank is to be formed;

C. hydraulic source means providing a supply of hydraulic fluid under pressure;

D. control means connected with said hydraulic source means and with at least one of said pressure chambers for effecting movement in unison of said tool parts, with said stop means engaged, from a press-open position of the tool parts in which they are both spaced a substantial distance from the pressure cavity to a press-closed position in which said one tool part is clampingly juxtaposed to said surface on the cylinder member;

E. pressure control valve means connected with said source means and having a connection with each of said pressure chambers;

F. program means for said pressure control valve means, responsive to the relative positions of said parts and cooperating with said control valve means to cause said parts to move from said press-closed position to forming positions in which the tool parts define the shape to which a blank is to be formed and said one tool part is clampingly juxtaposed to said surface on the cylinder member, said program means being arranged
   1. to direct flow of pressure fluid from said source means into the pressure chamber associated with the tool part that moves inwardly of the pressure cavity means during forming; and
   2. to control the pressure in the other pressure chamber by throttling of fluid flowing therefrom as the other tool part moves outwardly of the pressure cavity means during forming so that motion of said other tool part, due to displacement of fluid in the pressure cavity means, is yieldingly and controlledly resisted to determine the forming pressure in the pressure cavity means.

4. A fluid forming apparatus comprising a frame, a forming tool carried by said frame and having a pair of rigid tool parts that are movable relative to one another and said frame, and means on said frame defining a pressure cavity in which forming fluid is contained and which cooperates with the forming tool to effect a forming operation during which said fluid is under pressure and applies force over one face of a sheet metal blank while the forming tool engages the other face of the blank and relative movement of one of said tool parts in a direction towards the interior of the cavity brings it to a forming relationship with the other tool part at which the forming tool defines a shape that the blank is compelled to take, said forming apparatus being characterized by:

A said pressure cavity means being arranged to confine a volume of forming fluid which remains constant all during a forming operation;

B. a piston element for each of said tool parts, each piston element being connected with its tool part to be constrained to move therewith in said direction and in the opposite direction;

C. a cylinder on the frame for each piston element, each cylinder cooperating with its piston element to define a pressure chamber at the side of its piston element that is remote from the pressure cavity means and in which the piston element is movable in said directions;

D. means defining a limit of motion in said opposite direction of said one tool part relative to the other tool part, to establish a starting relationship of the tool parts, the last mentioned means being arranged to permit motion of said other tool part in said directions relative to its cylinder;

E. means operative when the tool parts are in their starting relationship for effecting relative movement in said one direction between the forming tool and the pressure cavity means from a press-open relationship in which the forming tool is substantially spaced from the pressure cavity means to a press-closed relationship in which the forming tool is adjacent to the pressure cavity means;

F. source means providing a supply of fluid under pressure;

G. means operative when the pressure cavity means and the forming tool are in their press-closed relationship for directing pressurized fluid from said source means to the pressure chamber for said one tool part, to force said one tool part in the first mentioned direction and thereby cause it, acting through a blank, to displace forming fluid in the cavity; and H. control valve means for metering flow of fluid out of the pressure chamber for the other tool part at a rate to maintain a fluid pressure therein which controls the pressure of forming fluid in said pressure cavity but which can be substantially lower than pressure in said cavity.

5. The fluid forming apparatus of claim 4, further characterized by:

said control valve means being connected with said source means and with the pressure chamber for said one tool part.

6. The fluid forming apparatus of claim 5, wherein said means on the frame defining a pressure cavity comprises a plunger which remains in a fixed position relative to the frame during a forming operation, and a further cylinder, slidably embracing the plunger, further characterized by:

I. sensing means for constantly detecting the position of at least said one of the tool parts relative to said plunger;

J. program means defining a predetermined variation of pressure of forming fluid in the pressure cavity in relation to the changing position of said one tool part relative to said plunger;

K. signal generating means connected with said sensing means and with said program means for producing an output which at every instant has a magnitude that corresponds to the forming fluid pressure signified by the program means for the sensed position of said one tool part relative to said plunger; and L. actuator means for the control valve means, connected with said signal generating means and operative to cause the control valve means to maintain the pressure in said one pressure chamber at a value that corresponds to the magnitude of said output.

7. The forming apparatus of claim 4 wherein said means defining said limit of motion in said opposite direction of said one tool part relative to the other comprises:

cooperating abutment means constrained to motion in said directions with the respective tool parts and engageable when said tool parts are in their starting relationship.

8. The forming apparatus of claim 4 wherein said means on the frame defining a pressure cavity comprises a plunger which is fixed in relation to the frame and said cylinders, and a further cylinder slidably embracing said plunger, further characterized by:

said means for effecting relative movement in said one direction between the forming tool and the pressure cavity means comprising means for introducing pressure fluid into the pressure chamber for said other tool part in a volume sufficient to carry the forming tool, with the tool parts in their starting relationship, from its press-open relationship to the pressure cavity means to its press-closed relationship thereto.

* * * * *